US005115921A

United States Patent [19]

Lavelle

[11] Patent Number: 5,115,921

[45] Date of Patent: May 26, 1992

[54] SMALL PACKAGE DISPLAY APPARATUS

[76] Inventor: Wayne C. Lavelle, 7668 Beverly Dr., Rohnert Park, Calif. 94928

[21] Appl. No.: 636,423

[22] Filed: Dec. 28, 1990

[51] Int. Cl.[5] ..... G09F 1/00; A47G 29/00

[52] U.S. Cl. ..... 211/71; 211/59; 211/205

[58] Field of Search ..... 211/71, 89, 205, 196, 211/193, 45; 248/121; 40/124, 124.2, 124.4

[56] References Cited

U.S. PATENT DOCUMENTS

| | | | |
|---|---|---|---|
| 2,017,944 | 10/1935 | Braley | 211/89 |
| 2,116,386 | 5/1938 | Copeland | 211/71 X |
| 2,937,758 | 5/1960 | Tabb | 211/89 X |
| 4,461,387 | 7/1984 | Belokin, Jr. | 211/89 X |
| 4,587,752 | 5/1986 | Swamy | 40/124 |

FOREIGN PATENT DOCUMENTS

| | | | |
|---|---|---|---|
| 1555703 | 12/1968 | France | 211/89 |
| 81314 | 5/1956 | Netherlands | 211/89 |
| 9558 | of 1913 | United Kingdom | 211/89 |

*Primary Examiner*—Karen J. Chotkowski
*Attorney, Agent, or Firm*—William W. Haefliger

[57] ABSTRACT

A display for articles in substantially flat packages, each having a cross dimension less than three inches comprising an upright standard, and branches carried by the standard and projecting laterally therefrom; the branches incorporating clips, each clip having two jaws, one of which is yieldably biased toward the other; and including the packages partially inserted between the jaws of the clips so that the packages have portions that freely project away from the clips standard, as continuations of the branches.

7 Claims, 2 Drawing Sheets 45a
46
17a
45
46a
44
41
14a
50
51
21
24d
42
23b
14
43
17
22
23
24
15a
23a
41
18a
4
21
24d'
21
42
23
22
22
23b
18
24a
20
23a
20
24
15
19a
24b
4
21
21
16a
16
22
24
19
10
12
13
11

SMALL PACKAGE DISPLAY APPARATUS

BACKGROUND OF THE INVENTION

This invention relates generally to small package display devices, and more particularly to devices to display flat packages in freely projecting, spaced and supported relation, allowing ready pull-free of the packages, as required.

There is need for display devices of the type referred to, whereby the packages can be quickly and easily grasped and pulled free of support, as required. Also, there is need for such improved display devices as are disclosed herein, and which allow ready loading of flat packages into the display devices, so as to be readily pulled free. Such packages typically have cross-dimensions less than about three inches.

SUMMARY OF THE INVENTION

It is a major object of the invention to provide an improved, tree-like display device, as referred to. Basically, the device comprises:

(a) an upright standard, (b) and branches carried by the standard and projecting laterally therefrom, (c) the branches incorporating clips, each clip having two jaws, one of which is yieldably biased toward the other, (d) and including the packages partially inserted between the jaws of the clips so that the packages have portions that freely project away from the clips and standard, as continuations of the branches.

It is another object to provide packages and clips that have complementary coloring, each package and its associated clips extending at the same angle relative to the standard.

Another object is to provide branches, clips and support packages that extend downwardly and laterally away from the standard to facilitate pull-out release of the packages from the clips.

Another object is to provide clips in the form of clothes pins, including two levers, one lever attached to the top of one of the branches, the other lever located above the first lever, the other lever having a handle projecting into proximity to the standard. The levers define the jaws, spaced above and laterally from lower ends of the branches whereby the branches have upwardly exposed upper sides adapted to support the packages.

These and other objects and advantages of the invention, as well as the details of an illustrative embodiment, will be more fully understood from the following specification and drawings, in which:

DRAWING DESCRIPTION

DETAILED DESCRIPTION

Figure 1:
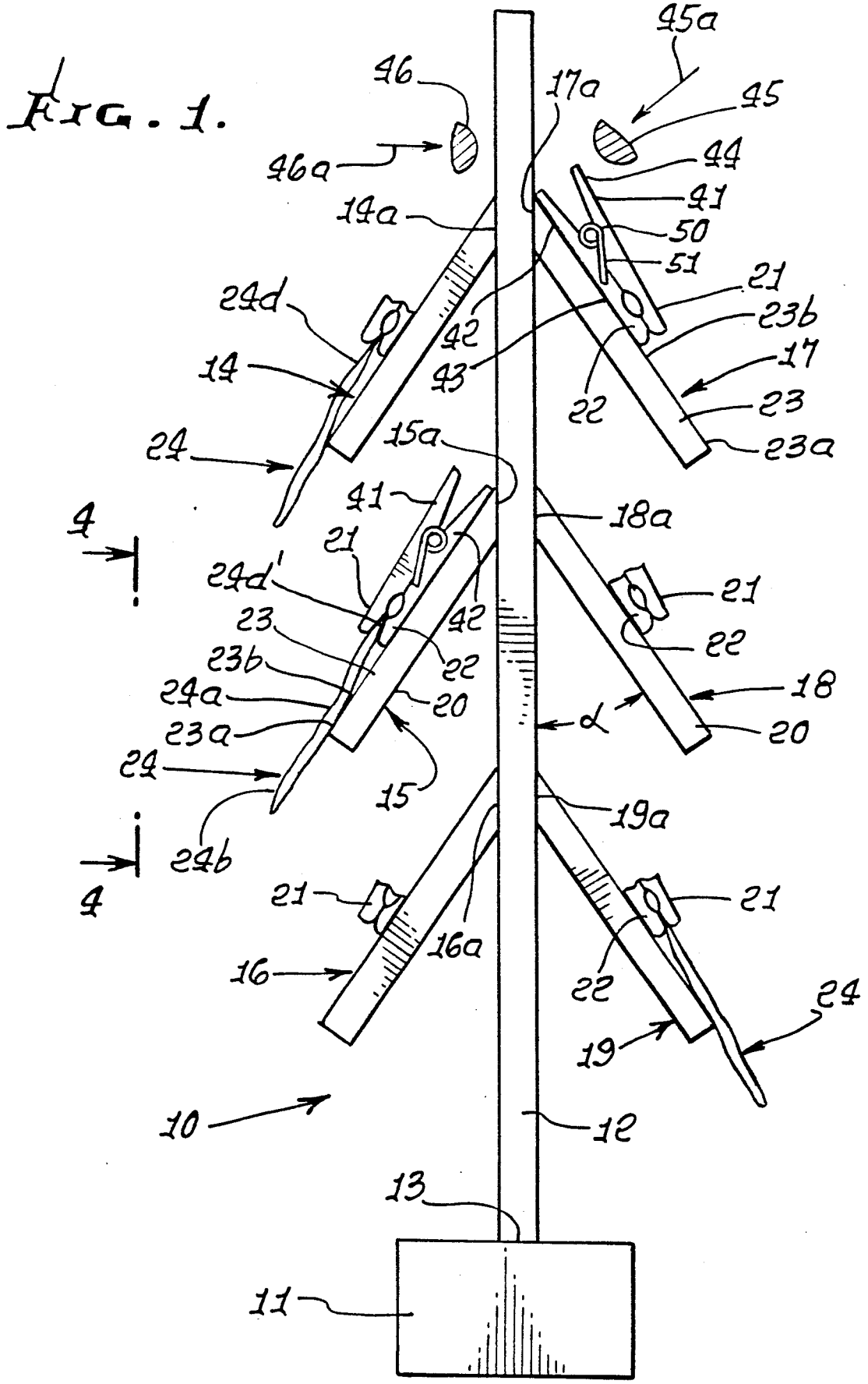
FIG. 1 is an elevation showing a tree-like display device incorporating the invention.

In the drawings, a tree-like apparatus 10 includes a base 11, an upright standard 12 fixed to the base at 13, and branches attached to the standard. Branches 14–16 are at the left side of the standard, and attached thereto at different vertical locations 14*a*–16*a*. Branches 17–19 are at the right side of the standard and attached thereto at different vertical locations 17*a*–19*a*. All the branches extend downwardly and laterally, as shown, at an angle or angles $\alpha$ relative to vertical, where $\alpha$ is larger than 20° and less than 60° to resemble tree branches. The branches may comprise wooden or plastic members 20 square cross sections; and the standard may also comprise such a member.

Figure 2:
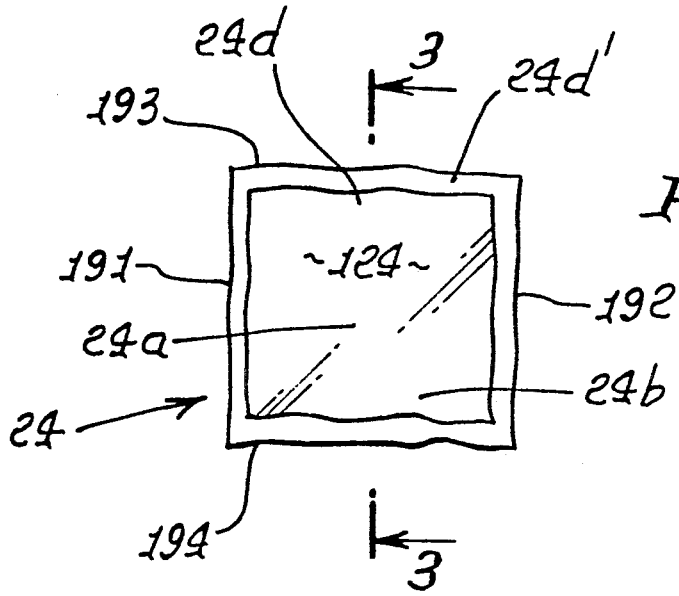
FIG. 2 is a side elevation showing a display package to be retained by the device of FIG. 1.
Figure 3:
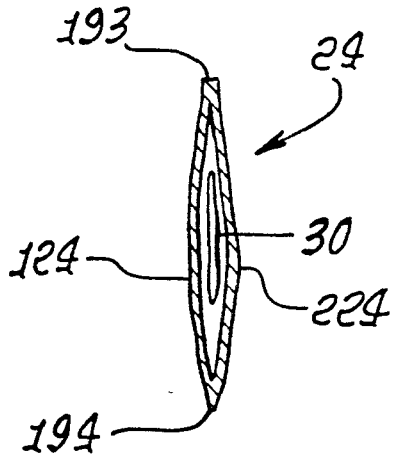
FIG. 3 is a section taken on lines 3-3 of FIG. 2.
Figure 4:
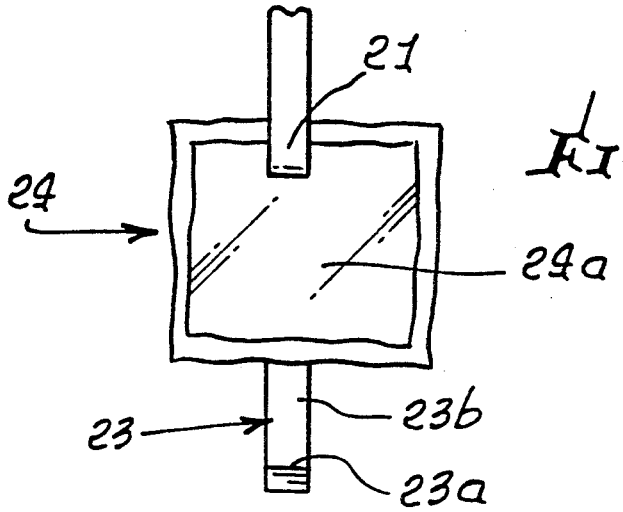
FIG. 4 is a side elevation taken on lines 4-4 of FIG. 1.

The branches typically incorporate clips, each clip having two jaws, one of which is yieldably biased toward the other. See for example upper jaws 21 biased downwardly toward lower jaws 22. Such jaws are located immediately above the flat, upper surface 23 of the branch member 20, and spaced from and laterally above the level of the lower ends 23*a* of surface 23. Thus, the flat surfaces 23*b* between the jaws and ends 23*a* provide supports for mid portions 24*a* of substantially flat packages 24, releasably retained by the pairs of jaws. The mid and lower portions 24*a* and 24*b* of the packages freely project downwardly and away from the clips and standard, as continuations of the tree-like branches. Lower ends 24*a* of the packages may extend beyond the lower ends 23*a*, as shown. Upper portions 24*d* of the packages have central zones 24*d'* retained by the jaws, as shown. The yieldable biasing of the jaws toward one another is such as to allow ready downward and lateral pull-out or pull-free of the packages from between the jaws, i.e., quick, ready dispensing, as required or needed. Such packages may consist of slick surface, flexible plastic sheet material. Articles in the packages may take various forms, such as condoms 30 or moisturized cleaning tissues, allowing flat form, lightweight packages and ready dispensing. See FIGS. 2 and 3, and opposite sides 124 and 224 of the package 24, peripherally joined at edge zones 191–194.

Finally, as seen in FIG. 1, the clips may advantageously have the form of clothes pins, with upper and lower levers 41 and 42. Lower lever 42 is fixed to the upper side of a branch member, as by bonding at 43. The upper lever 41 has a handle 44 projecting into proximity to the standard. This allows ready press-down of handle by the user's finger 45, with his thumb 46 pressing against the standard in directions indicated by arrows 45*a* and 46*a*. Such unimpeded pressing of the standard, in a rightward direction as indicated by the arrow is further enabled by locating the uppermost extent of the handle 44 above the level of the entirety of the branch 14 at the opposite side of the standard from branch 17. Such handle press down serves to elevate the jaws 21, to allow insertion of the package upper portion 24*d'*, as referred to. A coil spring 50 has arms 51 engaging the levers to urge the jaws toward closed position.

The standard, branches and clips may have the same color, such as green, and the packages may have the same color or some may have another color, such as red.

I claim:

1. In a display device for articles in substantially flat packages, each having a cross dimension less than three inches, the combination comprising:

(a) an upright standard, (b) and branches carried by the standard and projecting laterally therefrom, (c) said branches incorporating clips, each clip having two jaws, one of which is yieldably biased toward the other, (d) and including said packages partially inserted between the jaws of the clips so that the packages have portions that freely project away from the clips and standard, as continuations of said branches, (e) said clips having the form of clothes pins, each clothes pin including two levers, one lever attached to the top of one of the branches, the other lever located above the first lever, the other lever having a handle projecting into proximity to the standard, the levers defining said jaws which are spaced above and laterally from lower ends of the branches whereby the branches have upwardly exposed upper sides that support said packages, with lower portions of the packages when hanging over and below lower ends of said upper sides of the branches, (f) said standard, branches and packages having tree-like configuration wherein each branch is attached at an upper end to the standard substantially opposite and adjacent the upper end of another branch, (g) said packages also extending downwardly and laterally away from the standard to facilitate pull-out release of the packages from the clips, (h) the uppermost extent of said one lever handle projecting into close proximity to the standard also projecting above the level of the entirety of said another branch that is located at the side of the standard opposite said one branch.

2. The combination of claim 1 wherein the packages and clips have complementary coloring, each package and its associated clips extending at the same angle relative to the standard.

3. The combination of claim 2 wherein the branches extend downwardly and laterally away from the standard.

4. The combination of claim 1 wherein the branches extend at opposite sides of the standard.

5. The combination of claim 1 wherein said articles in said packages comprises for example condoms and moistened cleansing tissues, each package being flat and retained by only one said clothes pin like clips.

6. The combination of claim 1 wherein said articles in said packages comprises for example condoms and moistened cleansing tissues.

7. The combination of claim 1 wherein said articles comprise condoms.

* * * * *